United States Patent [19]

Cotabish et al.

[11] 3,980,081

[45] Sept. 14, 1976

[54] SELF-RESCUE BREATHING APPARATUS

[75] Inventors: Harry N. Cotabish, Allison Park; Ellison Lloyd Davison, Gibsonia, both of Pa.

[73] Assignee: Mine Safety Appliances Company, Pittsburgh, Pa.

[22] Filed: June 25, 1975

[21] Appl. No.: 590,382

[52] U.S. Cl. ..... 128/147; 128/191 R; 128/202; 55/312; 55/418

[51] Int. Cl.[2] ..... A62B 7/08

[58] Field of Search ..... 128/147, 142, 142.2, 128/142.3, 142.4, 142.5, 142.6, 142.7, 140 R, 191 R, 202, 203, 188; 55/312, 418 DIG. 33, DIG. 35

[56] References Cited

UNITED STATES PATENTS

| | | | |
|---|---|---|---|
| 1,691,648 | 11/1928 | Drager | 128/142.6 |
| 3,256,876 | 6/1966 | Elam | 128/188 |
| 3,794,030 | 2/1974 | Cotabish et al. | 128/202 |

FOREIGN PATENTS OR APPLICATIONS

| | | | |
|---|---|---|---|
| 208,565 | 6/1908 | Germany | 128/191 R |

*Primary Examiner*—Robert W. Michell
*Assistant Examiner*—Henry J. Recla
*Attorney, Agent, or Firm*—Brown, Murray, Flick & Peckham

[57] ABSTRACT

A self-contained pendulum breathing main unit includes a first canister containing a bed of oxygen generating and carbon dioxide removing chemical, a breathing hose connected with the canister inlet at one side of the bed and a breathing bag connected with an opening to the opposite side of the bed. Tubular connections are associated with the cannister inlet and outlet for connecting a supplemental unit thereto. There also is a normally open valve for the inlet. Attachable to the main unit is a supplemental breathing unit provided with a canister containing the same kind of chemical as the first canister. The supplemental unit has a tubular inlet which closes the normally open valve and connects the second canister with the breathing hose when the two units are attached to each other. The second unit also is provided with a tubular outlet which connects the second canister with said opening in the first canister to put the second canister in communication with the breathing bag.

12 Claims, 9 Drawing Figures

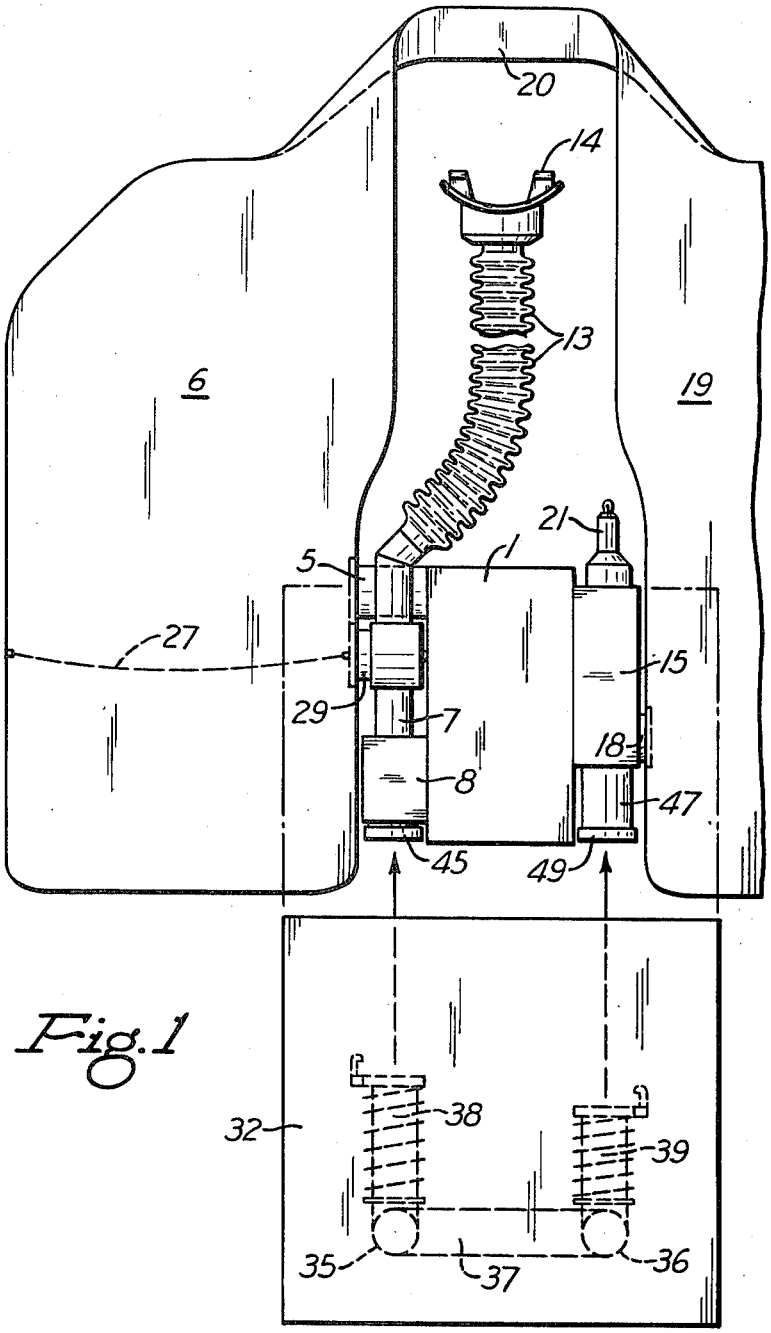
Fig. 1
Fig. 2
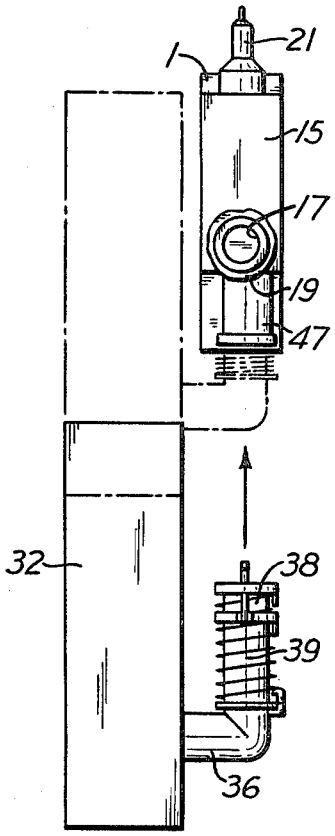
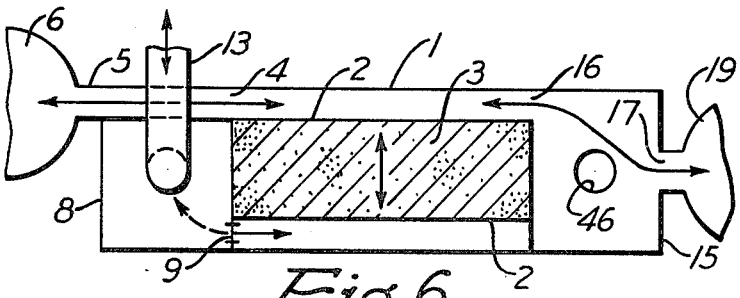
Fig. 6
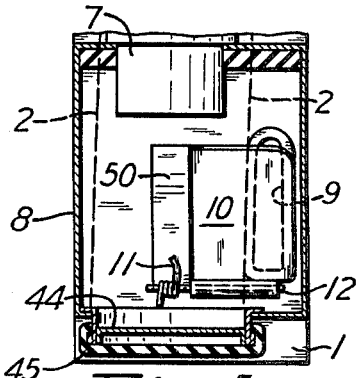
Fig. 5

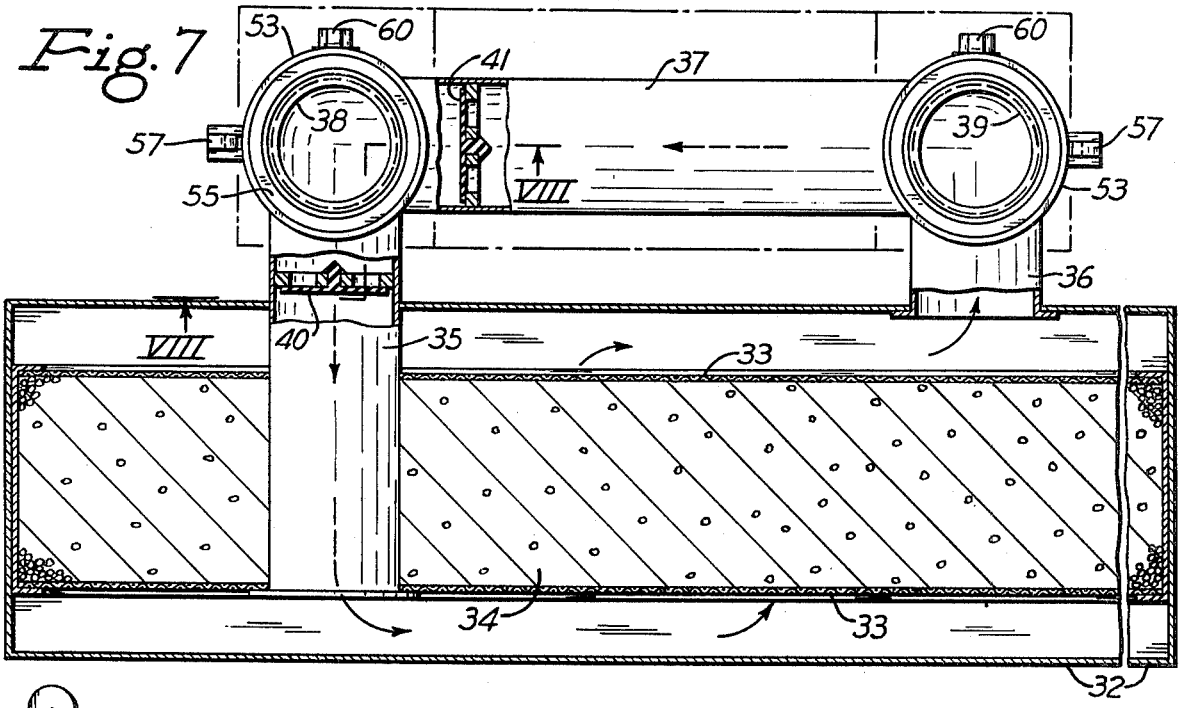
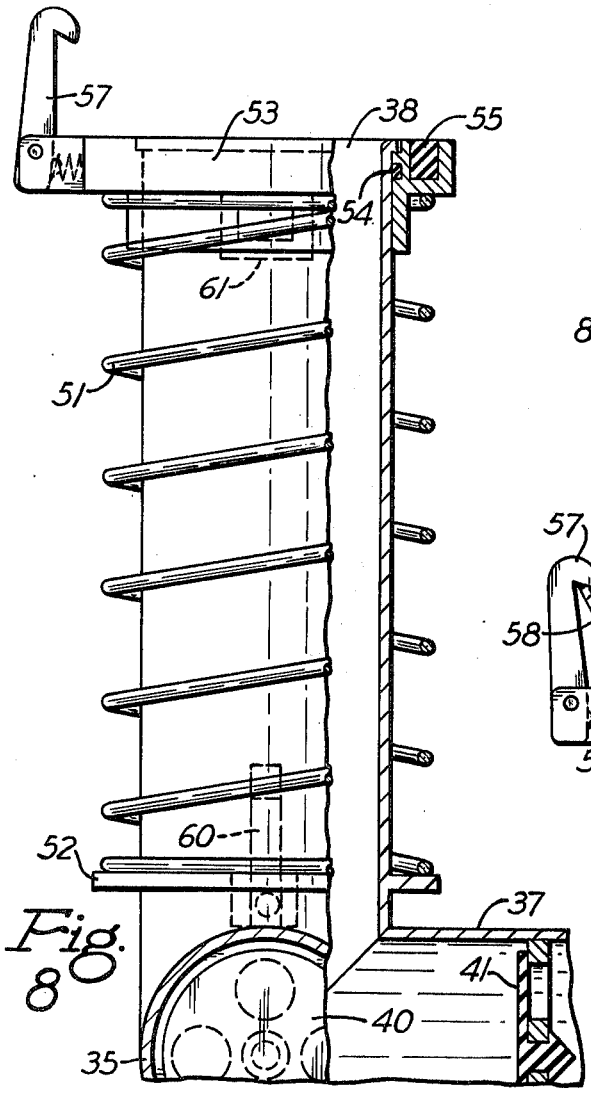
Fig. 8
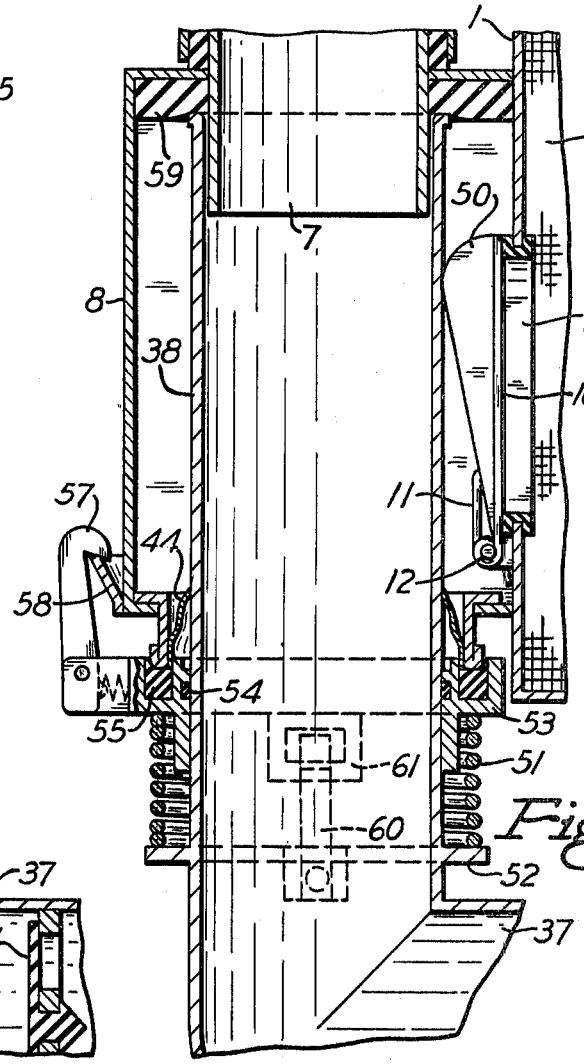
Fig. 9

SELF-RESCUE BREATHING APPARATUS

This invention resulted from work done under Contract No. HO252079 with the Bureau of Mines in the Department of the Interior and is subject to the terms and provisions of the President's Patent Policy Statement of Oct. 10, 1963.

Self-rescue breathing apparatus, such as that carried by minors should be as small and lightweight as possible so that it will not interfere with the work and movements of the miners. On the other hand, the apparatus must be capable of sustaining life for a reasonable period of time in the hope that the miners can be rescued if they have become trapped by a mine accident. This presents a problem because apparatus capable of sustaining life for even as little as one hour is cumbersome to wear while the miners are working.

It is an object of this invention to provide self-rescue breathing apparatus that generates oxygen and which includes a self-contained breathing unit that is small and compact and can be worn without interfering with the movements of the wearer but which will sustain live for only a few minutes. Another object is to provide such a unit which is formed for connection to a supplemental unit that is entirely separate from it but which can be quickly attached to it and which will greatly prolong the life-sustaining capability of the apparatus.

The preferred embodiment of the invention is illustrated in the accompanying drawings, in which FIG. 1 is a front view of the apparatus, with the supplemental unit in position to be attached to the main unit;

FIG. 2 is a fragmentary side view;

FIG. 5 is a vertical section taken on the line V—V of FIG. 4;

FIG. 6 is a diagram of the air flow in the main unit;

FIG. 7 is a plan view of the supplemental unit, with the canister shown in horizontal section;

FIG. 8 is an enlarged fragmentary view taken on the line VIII—VIII of FIG. 7; and FIG. 9 is a fragmentary view in vertical section showing one of the connections between the supplemental and main units.

Figure 3:
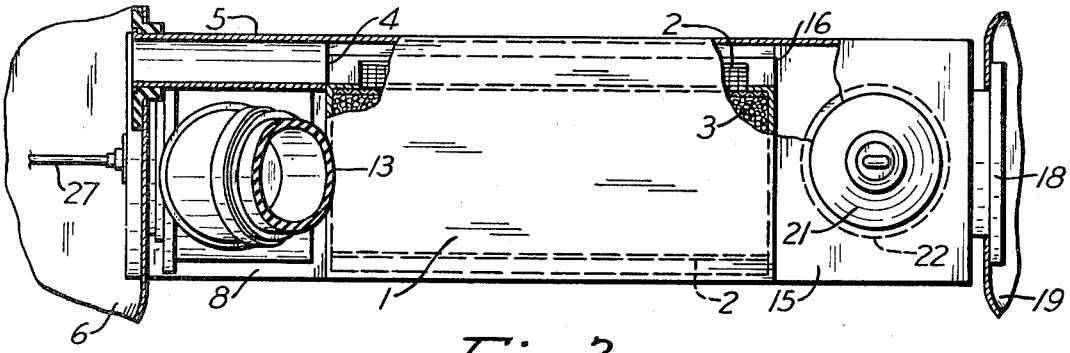
FIGS. 3 and 4 are enlarged fragmentary plan and front views, respectively, of the main unit, with parts broken away in section.
Figure 4:
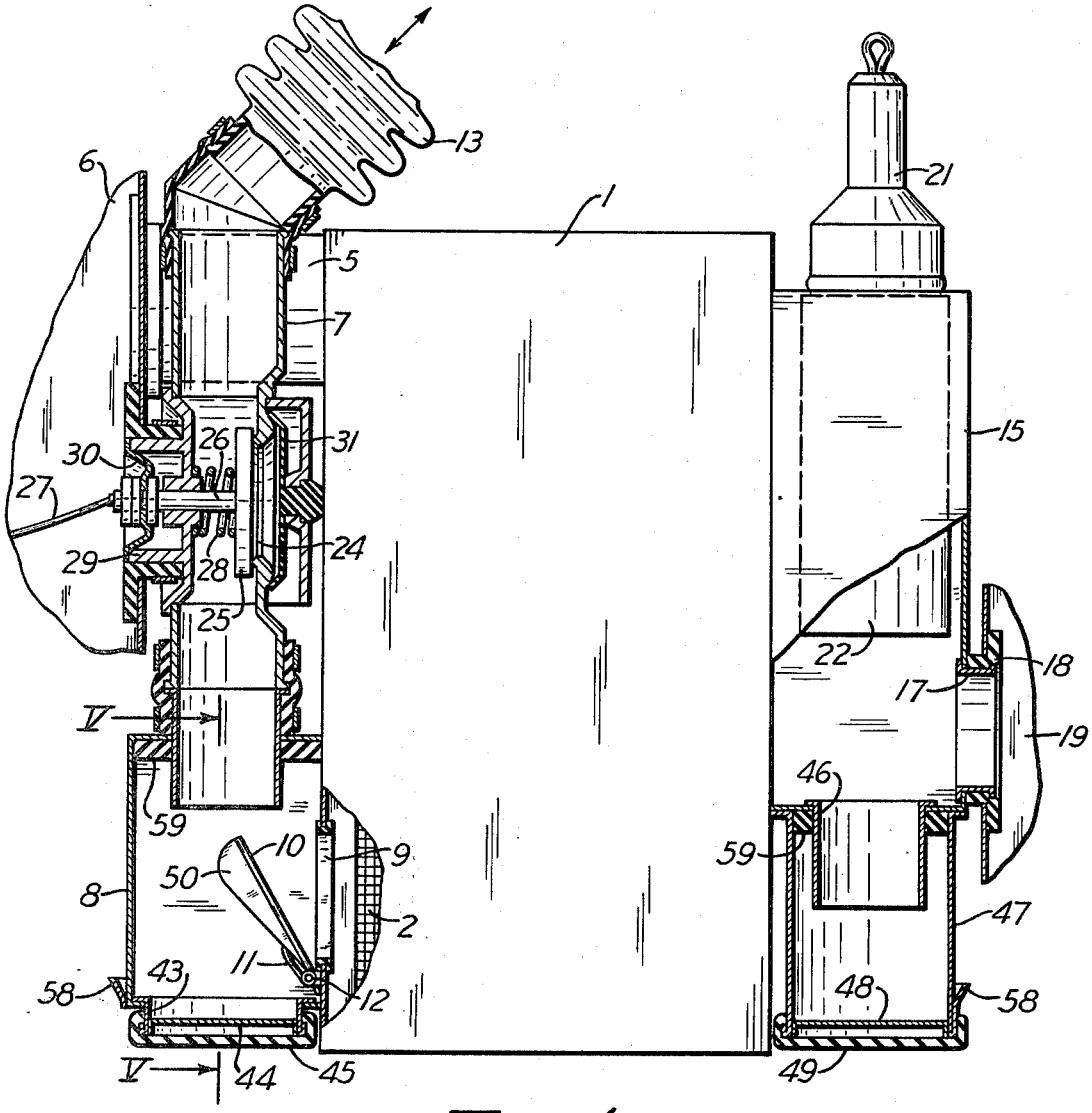

Referring to FIGS. 1 to 6 of the drawings, a main canister 1, preferably rectangular in shape, has a front and a back and two opposite sides. Inside this canister there is a pair of spaced perforated partition walls 2 extending from top to bottom of the canister and spaced from its front and back, to which they are inclined. A suitable chemical, such as potassium superoxide, is packed between the perforated walls to form a chemical bed 3. When the chemical is activated by moisture in the exhaled breath, it will generate oxygen and absorb carbon dioxide as is well known. The space or plenum behind the chemical bed is provided near the top of one side of the canister with an opening 4, from which a short rigid tube 5 extends laterally away from the canister, as shown in FIGS. 3 and 4. The outer end of the tube is sealed in an opening in a flexible breathing bag 6. In front of this tube there is a rigid vertical tube 7 that extends down through the top of a chamber 8 mounted on the side of the canister. Inside this chamber the side of the canister is provided with an opening 9 into the space or plenum in front of the chemical bed, as shown in FIGS. 4 and 5. A flap valve 10 that can close this opening is mounted in the chamber and normally is held open by a torsion spring 11 mounted on the pivot pin 12 of the valve. Connected to the upper end of tube 7 is a flexible breathing hose 13, to the upper end of which a bite piece 14 (FIG. 1) is attached so that the upper end of the hose can be held in the mouth. A nose clip (not shown) is furnished for shutting off breathing through the nose.

It will be seen that when the user of this apparatus exhales, the exhaled air will flow down through the hose and tube 7 and then through inlet 9, into the front plenum and through the chemical bed and then out into breathing bag 6. During inhalation, purified air, to which oxygen has been added by the chemical bed, will be drawn out of the bag and back through the bed and inlet, which now serves as an outlet, and into the breathing hose. This system of breathing, which is illustrated by the arrows in FIG. 6, is the pendulum system because the air flows back and forth through the same chemical bed.

Secured to the side of canister 1 opposite bag 6 is a box 15. The side of the canister between this box and the back plenum is provided with an opening 16 (FIG. 3) to place the back plenum in communication with the inside of the box. The lower part of the box is provided with an external opening 17 and a tubular fitting 18 that connects it with an opening in a second breathing bag 19. As shown in FIG. 1, the two breathing bags are independent of each other but may be connected by a neck strap 20 so that this apparatus can be hung around the neck of a man, with the canister suspended by the bags in front of his chest.

Mounted on top of box 15 there is a manually operated firing mechanism 21 of any suitable construction for igniting an oxygen producing candle 22 that extends down into the box. This candle, when ignited, will produce oxygen to help inflate the bags quickly before the chemical reaction in the canister has become fully effective.

Since the chemical usually generates oxygen faster than it is used, it is desirable to provide for release of excessive pressure in the apparatus. This has been done in the past by providing a breathing bag with a pressure relief valve, but since the bag contains purified air with added oxygen it is a waste of oxygen to release it to the atmosphere directly from the bag. With the pressure relief system about to be described, it is exhaled air, not oxygen and purified air, that is released before it can pass through the canister, whereby the life of the chemical bed is prolonged. This is accomplished by providing the side of tube 7 remote from bag 6 with an outlet port 24 as shown in FIG. 4. The inner end of the port is normally closed by a spring-pressed valve 25 that has a stem 26 slidably mounted in the opposite side of the tube. This stem extends into the adjoining breathing bag, in which it is sealed, and the inner end of the stem is connected by a flexible tension member, such as a chain or pull cord 27, to the opposite side of the bag. The area of the bag around the valve stem, but spaced a short distance from it, is anchored to tube 7 so that when the pressure in the bag starts to become excessive and the bag is expanded enough to take the slack out of the pull cord, further expansion will cause the cord to pull the valve off its seat and thereby allow air being exhaled to escape to the atmosphere. Then, as the bag starts to deflate, the valve is closed by spring 28. One way of attaching the bag to the tube is to cut a hole in the bag and attach it to an annular flange 29 projecting from the side of tube 7 around the valve stem. The stem is rigidly mounted in the center of a flexible diaphragm 30 secured to the flange, so the diaphragm takes the place of the piece of the bag that was cut out. To prevent any chance of noxious gas entering tube 7 while the valve is open, it is desirable to provide a shielded check valve 31 for closing the outlet of the valve port against entrance of gas.

The apparatus described thus far forms a self-contained pendulum breathing unit, which is the main unit of this apparatus. To keep the unit small and compact, the canister is made small enough to contain only enough chemical to sustain life for about ten minutes. This may be long enough to permit the miner to escape from the mine or to an area where the ambient air is safe for breathing. In any event, it should be long enough to permit him to reach a location in the mine where long-life supplemental canisters have been stored for emergency use. The main unit worn by the miner and the supplemental units are constructed in such a way that a supplemental unit can be quickly attached to the main unit. The canister of the supplemental unit is considerably larger than the canister of the main unit in order to contain more chemical, preferably enough to sustain life of about an hour. Such a large unit is not suitable for a man to carry while he is working, so it is stored in a location not far from the working area.

As shown in FIGS. 1, 2, and 7 to 9, the supplemental unit includes a rectangular canister 32, in which there is a pair of spaced parallel upright partition walls 33 that are perforated and also spaced from the front and back of the canister. A chemical 34 like that in the main unit is packed between the perforated walls. The back wall of the canister is provided near one lower corner with an inlet opening, through which a tube 35 extends as shown in FIG. 7. It also extends forward through the chemical bed and opens into the front plenum in the canister. The back wall of the canister also is provided with an outlet opening, from which a short tube 36 projects. The outer end of this tube is connected with the outer end of the other tube 35 by means of a horizontal linking tube 37 parallel to the back of the canister. Where the linking tube joins the other two tubes there are parallel stub tubes 38 and 39, preferably extending upwardly and having open outer ends. An inhalation check valve 40 in inlet tube 35 allows air to flow through it only toward the front of the canister. An exhalation check valve 41 in the linking tube 37 allows air to flow through it only in a direction away from the canister. With these two valves, air can flow in only one direction through the canister. A single direction air flow is desirable, instead of pendulum flow, because with the larger canister pendulum flow would cause the chemical bed to generate too much heat. Nevertheless, pendulum flow would be possible by omitting or plugging linking tube 37 and also omitting inhalation check valve 40.

To enable this supplemental unit to be attached to the main unit before the chemical in the latter is exhausted, the main unit is formed for receiving the two stub tubes 38 and 39. Thus, as shown in FIG. 4, the bottom of chamber 8 is provided with a circular supplemental opening 43 for receiving stub tube 38. This opening normally is sealed by a disc 44 of metal foil that is protected from below by a removable cover 45. At the other side of the canister the bottom of box 15 is provided with a supplemental opening 46 that opens into the upper end of a short tube 47 rigidly connected to the box and forming a downwardly extending extension of the opening. This tube or opening is of such diameter as to receive stub tube 39. The lower end of the tube normally is sealed by a foil disc 48 that is protected by a removable cover 49.

To provide a sealed connection between the two units and also to attach the supplemental unit to the main unit so that it will be suspended therefrom, each of the stub tubes is encircled by a coil spring 51 resting on a collar 52 encircling the tube. At the upper end of each spring there is a sealing ring 53 provided with grooves containing an inner sealing ring 54 encircling the tube and an outer gasket 55 for engaging the wall of chamber 8 or the lower end of short tube 47 around the supplemental openings when the two units are connected.

When it is desired to attach the supplemental unit to the main unit, the supplemental canister is held in front of the main unit with the two stub tubes 38 and 39 directly below the two foil seals 44 and 48, from which the protective covers have been removed, and with gaskets 55 engaging the main unit around the seals. Then the supplemental unit is raised to press the gaskets tightly against the main unit and then to cause the stub tubes to break through the foil seals. Spring-pressed latches 57 carried by the sealing rings will snap over tabs 58 projecting from the main unit as shown in FIG. 9, thereby locking the two units together. As the supplemental unit is raised further into the dotted-line position shown in FIGS. 1 and 2, stub tube 38 will close valve 10 by engaging a cam 50 projecting from the valve, thereby cutting off the inlet to the main canister from the breathing system so that the supplemental unit will not be short circuited. However, openings 4 and 16 are not closed for safety reasons. That is, if they were closed too and oxygen continued to be generated in the main canister, the canister might explode.

As the supplemental unit is raised still further, which will cause the coil springs to press the sealing rings into place still more tightly, and also will press the upper ends of the stub tubes against sealing gaskets 59 in the upper ends of the sockets formed by chamber 8 and tube 47, spring-pressed latches 60 on the tubing below the coil springs will snap into slots in lugs 61 extending downwardly from the sealing rings. This will prevent the coil springs from expanding when the hands are removed from the supplemental unit, which will then hang from the main unit by means of the latches. Stub tube 38 now will be in direct communication with the breathing hose, while the other stub tube will be in communication with breathing bag 19 and with the other breathing bag via openings 16 and 4 in the side walls of the main canister. Breathing will now be in a single direction through the supplemental canister, which also is in communication with both of the breathing bags, but the main canister will be bypassed.

Unlike conventional mine rescue apparatus, which serves only as a scrubber, the apparatus disclosed herein also generates oxygen for the miner to breathe.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. In self-rescue breathing apparatus, a self-contained pendulum breathing main unit comprising a first canister having opposing sides and containing a bed of oxygen generating and carbon dioxide removing chemical therebetween, the canister having inlet means on one side of the bed for directing exhaled air through said bed and an opening at the opposite side of the bed, a normally open valve in said inlet means, a first breathing bag connected with said opening, and a breathing hose connected with said inlet means for exhaling through the canister into the bag and then inhaling from the bag through the canister; and a supplemental breathing unit; means for attaching said supplemental breathing unit to said main unit, said supplemental unit comprising a second canister having opposing sides containing a bed of oxygen generating and carbon dioxide removing chemical therebetween, the second canister having inlet means for directing exhaled air through said bed from one side and outlet means for receiving exhaled air from the opposite side of the bed, first means forming part of the supplemental unit for closing said normally open valve and connecting the second canister inlet means with said hose when the two units are attached to each other, and second means forming part of the supplemental unit for simultaneously connecting the second canister outlet means with said opening in the first canister to put the second canister in communication with said bag.

2. In self-rescue breathing apparatus according to claim 1, wherein said first canister has first and second ports in communication with said opening and positioned at opposite ends of said opposite side, said first port connected to said first breathing bag, a second breathing bag in communication with second part, and a neck strap connecting the breathing bags for hanging said main unit in front of the chest of the user.

3. In self-rescue breathing apparatus according to claim 1, wherein said first canister has first and second ports in communication with said opening and positioned at opposite ends of said opposite side, said first port connected to said first breathing bag, an oxygen producing candle supported by the first canister in communication with said second port, and manually operable means for igniting the candle.

4. In self-rescue breathing apparatus according to claim 3, a box containing said candle and secured to said first canister around said second port, the box being provided with an exterior opening, and a second breathing bag connected with said exterior opening.

5. In self-rescue breathing apparatus according to claim 4, said box having a normally closed supplemental opening therein, and said second means includes means for connecting said second canister outlet means with said supplemental opening.

6. In self-rescue breathing apparatus according to claim 1, a rigid tube beside said bag and connecting said hose with said first canister inlet means, the side of said tube remote from the bag having an outlet port therein, a spring-pressed relief valve means normally closing the inner end of said port, means connecting the relief valve means with the adjacent side of the bag, and a flexible tension member secured to said relief valve means and the opposite side of the bag for pulling the relief valve off its seat if the bag expands beyond a predetermined size.

7. In self-rescue breathing apparatus according to claim 1, said main unit having a chamber connecting said hose with the inlet means to the first canister and containing said normally open valve, the chamber having a supplemental opening, a frangible seal closing the supplemental opening, said first means being a stub tube insertable through said supplemental opening and seal and engageable with said normally open valve to close said first canister inlet.

8. In self-rescue breathing apparatus according to claim 7, a sealing ring slidably mounted on said stub tube, a coil spring encircling the stub tube and urging the sealing ring toward the outer end of the tube, latch means for holding the sealing ring against said chamber when the stub tube is inserted therein, and latch means for connecting the stub tube to the sealing ring when said spring is compressed a predetermined amount.

9. In self-rescue breathing apparatus according to claim 7, wherein said first canister has first and second ports in communication with said opening and positioned at opposite ends of said opposite side, said first port connected to said first breathing bag, a box secured to said first canister around said second port and provided with an exterior opening, a second breathing bag connected with said exterior opening, the box also having a supplemental opening, and a frangible seal closing off said last-mentioned opening, said second means being a stub tube insertable through said last-mentioned seal.

10. In self-rescue breathing apparatus according to claim 9, said supplemental openings being at the bottom of said chamber and box, and said stub tubes being at the back of said second canister and extending upwardly and having open upper ends.

11. In self-rescue breathing apparatus according to claim 1, an inhalation check valve for said second canister inlet means, a conduit connecting the second canister outlet means with said first means, and an exhalation check valve in said conduit, whereby air can flow in only one direction through the second canister.

12. In self-rescue breathing apparatus according to claim 11, said conduit being disposed in back of said second canister and parallel thereto and substantially horizontal, and said first and second means include stub tubes extending upwardly from near the ends of the conduit and having open upper ends, the lower ends of the stub tubes communicating with the conduit at opposite sides of the exhalation check valve.

* * * * *